US006187217B1

(12) United States Patent
Arai et al.

(10) Patent No.: US 6,187,217 B1
(45) Date of Patent: Feb. 13, 2001

(54) THIN MAGNET ALLOY BELT AND RESIN BONDED MAGNET

(75) Inventors: Akira Arai, Shimosuwa-machi; Hiroshi Kato, Okaya, both of (JP)

(73) Assignee: Seiko Epson Corporation (JP)

( * ) Notice: Under 35 U.S.C. 154(b), the term of this patent shall be extended for 0 days.

(21) Appl. No.: 09/269,846

(22) PCT Filed: Jul. 23, 1998

(86) PCT No.: PCT/JP98/03327

§ 371 Date: Mar. 31, 1999

§ 102(e) Date: Mar. 31, 1999

(87) PCT Pub. No.: WO99/07005

PCT Pub. Date: Feb. 11, 1999

(30) Foreign Application Priority Data

Jul. 31, 1997 (JP) ..... 9-206846

(51) Int. Cl.[7] ..... H01F 1/08
(52) U.S. Cl. ..... 252/62.54; 428/687; 148/302
(58) Field of Search ..... 148/302; 428/141, 428/156, 332, 338, 409, 900, 928, 687; 252/62.54, 62.55, 62.53

(56) References Cited

U.S. PATENT DOCUMENTS 5,209,789 * 5/1993 Yoneyama et al. ..... 148/302
5,622,768 * 4/1997 Watanabe et al. ..... 428/141
5,817,222 * 10/1998 Kuneko ..... 148/403
5,993,939 * 11/1999 Fukuno et al. ..... 428/167

FOREIGN PATENT DOCUMENTS 59-64739 4/1984 (JP) .
3-52528 8/1991 (JP) .
8-260112 10/1996 (JP) .

* cited by examiner

*Primary Examiner*—John Sheehan
(74) *Attorney, Agent, or Firm*—Harness, Dickey & Pierce, P.L.C.

(57) ABSTRACT

In order to secure stable magnetic properties in a magnet alloy ribbon obtained by a melt rapid cooling method, and obtain excellent magnetic properties and corrosion resistance in a bonded magnet, the area ratio of dimple-like recesses (22) present in the surface (roll surface) of the alloy ribbon in contact with a cooling roll during solidification is defined. As a result, an alloy ribbon for a magnet having stable magnetic properties can be obtained. The use of a powder obtained by grinding such an alloy ribbon enables formation of a bonded magnet having excellent magnetic properties and corrosion resistance.

6 Claims, 1 Drawing Sheet

THIN MAGNET ALLOY BELT AND RESIN BONDED MAGNET

TECHNICAL FIELD

The present invention relates to a magnet alloy ribbon, and particularly to a rare earth permanent magnet alloy ribbon, and a resin bonded magnet using a magnet powder obtained from the alloy ribbon.

BACKGROUND ART

In regard to a method of producing an alloy ribbon by jetting an alloy melt of a rare earth magnet material on a single metallic roll, Japanese Examined Patent Publication No. 3-52528 discloses in line 30 of column 7 on page 4 to line 42 of column 9 on page 5 that an alloy ingot sample is placed in a quartz tube and melted, and then the melt is jetted at a constant speed on a metallic disk having too high heat capacity for the melt through a circular orifice provided in the lower portion of the quartz tube to obtain an alloy ribbon. Japanese Unexamined Patent Publication No. 59-64739 reports that for a rare earth-transition metal-B system magnet composition, the rotational speed of a roll is an important factor which influences the magnetic properties of an alloy ribbon.

However, consideration has not been given to how the detailed dimensions, shape and surface state of an alloy ribbon affect magnetic properties.

In addition, a permanent magnet material produced by a conventional rapid cooling method has the following problems.

1) Magnetic properties deteriorate due to variations in the micro structure which constitutes the alloy ribbon.

2) In the formation of a bonded magnet, when a resin is nonuniformly adhered to a magnet powder, reliability, particularly corrosion resistance, deteriorates.

SUMMARY OF INVENTION

The present invention has been achieved for solving the problems of a conventional technique. In consideration of the surface state of the surface (roll surface) in contact with a roll for mainly cooling an alloy ribbon, a first object of the present invention is to provide an alloy ribbon having excellent magnet characteristics.

A second object of the present invention is to provide a resin bonded magnet having excellent magnetic characteristics and reliability, and formed by bonding a resin and a powder produced by grinding the alloy ribbon as it is or after heat treatment.

In order to achieve these objects, a magnet alloy ribbon of the present invention is obtained by jetting a R-TM-B system (R is a rare earth element such as Nd or Pr, and TM is a transition metal) alloy melt on a rotating metallic roll to rapidly solidify the alloy melt, wherein the total area ratio of dimple-like recesses after solidification, which are present in the surface (roll surface) of the ribbon in contact with the roll during solidification, is 3 to 25%.

A magnet alloy ribbon of the present invention is obtained by jetting a R-TM-B system (R is a rare earth element such as Nd or Pr, and TM is a transition metal) alloy melt on a rotating metallic roll to rapidly solidify the alloy melt, wherein the total area ratio of dimple-like recesses, each of which has an area of 2000 $\mu m^2$ or more and which are present in the surface (roll surface) of the ribbon in contact with the roll during solidification, is 0 to 5%.

A magnet alloy ribbon of the present invention is obtained by jetting a R-TM-B system (R is a rare earth element such as Nd or Pr, and TM is a transition metal) alloy melt on a rotating metallic roll to rapidly solidify the alloy melt, wherein the d/t ratio of the average depth (d) of dimple-like recesses to the average thickness (t) of the alloy ribbon after solidification, which recesses are present in the surface (roll surface) of the ribbon in contact with the roll during solidification, is 0.1 to 0.5.

A resin bonded magnet of the present invention is formed by grinding a magnet alloy ribbon as it is or after heat treatment, which is obtained by jetting a R-TM-B system (R is a rare earth element such as Nd or Pr, and TM is a transition metal) alloy melt on a rotating metallic roll to rapidly solidify the alloy melt, to form a powder; mixing the thus-obtained power and a resin; and then molding the mixture; wherein the total area ratio of dimple-like recesses after solidification, which are present in the surface (roll surface) of the ribbon in contact with the roll during solidification, is 3 to 25%.

A resin bonded magnet of the present invention is formed by grinding a magnet alloy ribbon as it is or after heat treatment, which is obtained by jetting a R-TM-B system (R is a rare earth element such as Nd or Pr, and TM is a transition metal) alloy melt on a rotating metallic roll to rapidly solidify the alloy melt, to form a powder; mixing the thus-obtained powder and a resin; and then molding the mixture; wherein the total area ratio of dimple-like recesses, each of which has an area of 2000 $\mu m^2$ or more and which are present in the surface (roll surface) of the ribbon in contact with the roll during solidification, is 0 to 5%.

A resin bonded magnet of the present invention is formed by grinding a magnet alloy ribbon as it is or after heat treatment, which is obtained by jetting a R-TM-B system (R is a rare earth element such as Nd or Pr, and TM is a transition metal) alloy melt on a rotating metallic roll to rapidly solidify the alloy melt, to form a powder; mixing the thus-obtained powder and a resin; and then molding the mixture; wherein the d/t ratio of the average depth (d) of dimple-like recesses to the average thickness (t) of the alloy ribbon after solidification, which recesses are present in the surface (roll surface) of the ribbon in contact with the roll during solidification, is 0.1 to 0.5.

In accordance with claims the present invention, the surface state of the surface (roll surface) of the magnet alloy ribbon which contacts the roll, particularly the area ratio of dimple-like recesses present in the surface, is defined to provide an alloy ribbon having excellent magnet properties.

In accordance with therefor of the present invention, the thus-obtained alloy ribbon is ground as it is or after heat treatment to form a powder, and the thus-obtained powder is mixed with a resin and then molded to provide a resin bonded magnet having excellent magnetic properties and reliability.

BEST MODE FOR CARRYING OUT THE INVENTION

An embodiment of the present invention will be described below.

1) Outlines of production method (magnet alloy ribbon and resin bonded magnet)

Figure 1:
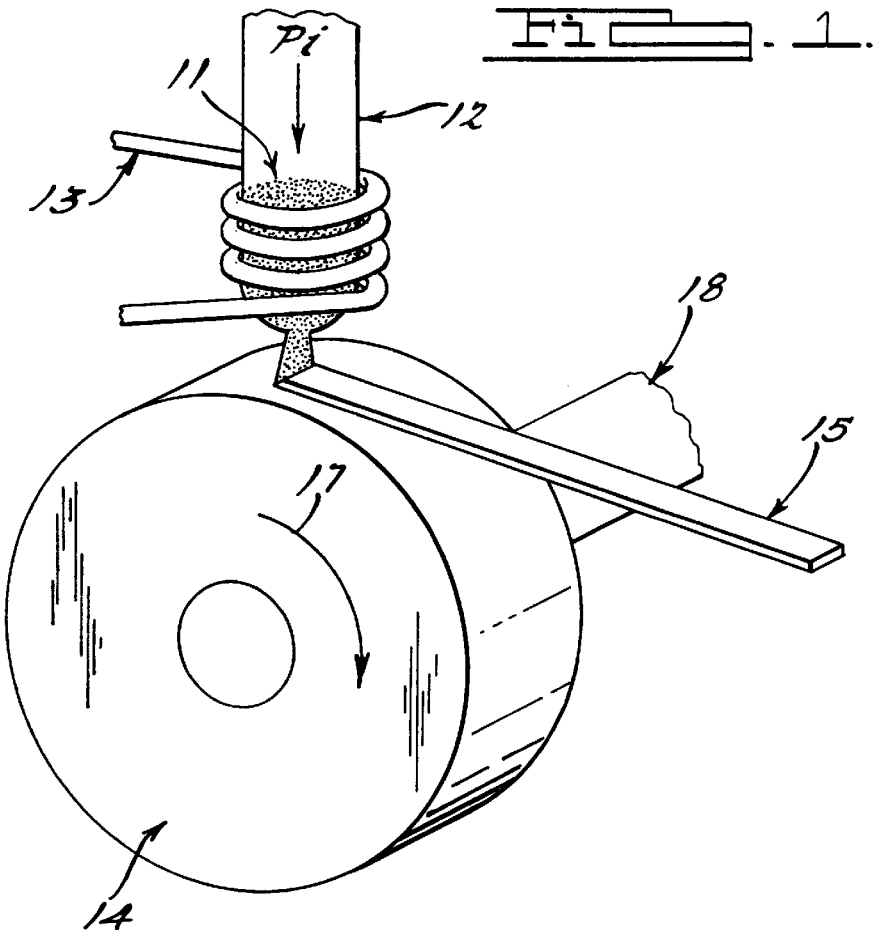
FIG. 1 is a schematic drawing of an apparatus for producing a magnet alloy ribbon.

FIG. 1 is a schematic drawing of an apparatus (super rapid cooling method) for producing a magnet alloy ribbon 15 by using a single roll 14. This apparatus is installed in a chamber which can be evacuated. Schematically, a current is passed through a radio frequency heating coil 13 wound on a nozzle 12, which is filled with a raw material or a master alloy in an inert atmosphere, to melt the raw material or master alloy by induced electric current, to obtain an alloy melt 11. Heating means is not limited to radio frequency heating, and a method comprising providing a heating element such as a carbon heater or the like on the periphery of the nozzle may be used. Then, the melt is jetted on a metallic single roll which is set directly below a crucible and which is rotated about an axis 16 at a high speed, through an orifice (opening) provided at the bottom of the nozzle. Since the metallic roll has a high heat capacity for the jetted melt, the melt is solidified on the roll 17, as well as being extended in the rotational direction of the roll to form an alloy ribbon. Each of terms will be described in further detail below.

The nozzle may be filled with each raw material metal which is weighed so as to have the desired composition (R-TM-B system) or a sample which is cut off from a master alloy ingot previously produced in a radio frequency melting furnace and having the desired composition. Although the nozzle is preferably made of a quartz material, other ceramic materials such as high-heat-resistant alumina and magnesia, and the like may be used. The orifice (opening) preferably comprises a circular hole or a slit. However, in the case of a slit, the length direction of the slit is preferably as close to the direction (width direction of the ribbon) 24 perpendicular to the rotational direction of the roll as possible.

The metallic roll is preferably made of a material such as a copper alloy, an iron alloy, chromium, molybdenum, or the like in order to obtain sufficient heat conductivity, and a metal-alloy layer having excellent corrosion resistance may be provided for improving durability. For example, hard chromium plating may be provided on the surface. Because the roll surface having excessive roughness deteriorates the wettability of the roll with the alloy melt, the surface must be finished by using abrasive paper to a sufficiently smooth surface having an average surface roughness of ⅓ or less of the ribbon thickness.

After setting such as sample filling, polishing of the roll, and the like, the chamber is evacuated to $10^{-2}$ torr by a vacuum pump, and an inert gas is introduced into the chamber to a desired pressure. As the inert gas, Ar, He, or the like may be used.

After the desired atmosphere is obtained, the content of the nozzle is melted to obtain the alloy melt, which is then jetted through the orifice at the bottom of the nozzle.

For jetting, a preferred method comprises jetting the inert gas into the space above the melt in the nozzle under an appropriate pressure (Pi), as schematically shown in FIG. 1. Specifically, a discharge device for the inert gas is provided on the upper portion of the nozzle through a solenoid valve so that the pressurized gas in the discharge device is discharged by opening the solenoid valve with timing for jetting to spray the alloy melt. The substantial injection pressure Pi of the alloy melt is a difference between the pressure of the inert gas in the discharge device and the atmospheric pressure in the chamber.

The alloy melt jetted as described above is rapidly solidified on the roll to form an alloy ribbon. Since the cooling rate in solidification increases as the rotational speed of the roll increases, the rotational speed of the roll must be appropriately set to obtain the desired metal structure. In order to obtain good magnetic properties, good magnetic properties may be obtained in an as-spun state (without heat treatment) or heat treatment may be performed after the alloy ribbon is partially or entirely made an amorphous structure. In the former method, the rotational speed of the roll must be set to an optimum value. In the latter method, the rotational speed is set to a value higher than the rotational speed at which optimum properties can be obtained in the as-spun state to partially or entirely make the alloy ribbon an amorphous structure in the as-spun state so that after heat treatment, the alloy ribbon is crystallized to obtain magnet characteristics. Although the heat treatment temperature depends upon the alloy composition, the heat treatment temperature is preferably in the range of a temperature immediately above the crystallization temperature to 800° C. At a temperature lower than the crystallization temperature, crystallization cannot be achieved, while at a temperature over 900° C., crystal grains are significantly coarsened, thereby obtaining unsatisfactory magnetic properties.

A magnet powder used for the bonded magnet is obtained by grinding the above-described magnet alloy ribbon which enables achievement of good magnet properties. During grinding, the average particle size of the powder is preferably 100 $\mu$m or less in consideration of moldability of the bonded magnet.

The thus-obtained powder is mixed with a thermosetting resin such as an epoxy resin or the like, or a thermoplastic resin such as a nylon resin or the like, and the mixture is molded to obtain the bonded magnet. As the molding method, compression molding, injection molding, extrusion molding, or the like can be used. If required, small amounts of a lubricant, an antioxidant, and the like may be added to the resin used.

2) Dimple-like recess

Figure 2:
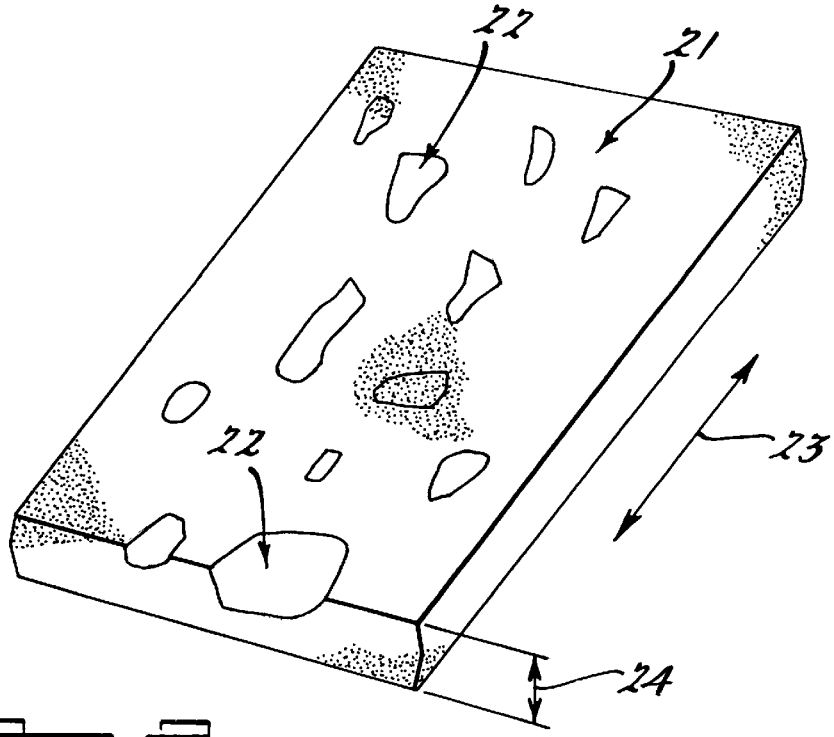
FIG. 2 is a schematic drawing showing the state of a magnet alloy ribbon.

Referring also now to FIG. 2 in-therefore the magnet alloy ribbon produced by the above-mentioned production method, as a result of observing of the surface (referred to as "the roll surface" in the present invention) of the alloy ribbon which contacts the metallic roll by a scanning electron microscope (SEM), dispersion of portions recessed in the shape of a dimple 22 (referred to as "the dimple-like recesses" in the present invention) was observed, as shown in FIG. 2. Such portions are possibly mainly caused by the atmospheric inert gas trapped between the alloy melt on the roll and the roll when the melt is rapidly solidified by jetting on the roll. Such trapping of the gas is possibly mainly due to the viscous flow of the gas generated near the roll surface with rotation of the roll.

Furthermore, as a result of SEM observation of a broken-out section of the ribbon, which was broken, the crystal grain diameter of a normal portion was on the order of several tens nm, while the crystal grain diameter of the main phase of a portion adjacent to the dimple-like recesses was relatively large, and coarse crystal grains of the order of 1 $\mu$m were observed in some portions.

The area ratio of the total area of the dimple-like recesses to the entire area of the roll surface was measured by image processing of photographs obtained by SEM observation of the roll surface of the alloy ribbon. In examples of the present invention which will be described below, the dimple-like recesses in at least ten photographs obtained by SEM observation at a magnification of several tens were first observed by using a contrast difference of an image, and the areas of the dimple-like recesses were converted to a number of pixels to calculate an area ratio. The area ratios of the ten photographs were averaged to obtain a value of the area ratio of the alloy ribbon.

The correlation between the area ratio of the dimple-like recesses and the magnetic properties of the magnet alloy ribbon was examined in detail. As a result, in the magnet alloy ribbon in which the area ratio of the dimple-like recesses was over 25%, all of coercive force, remanence, and residual magnetic flux density deteriorate to exhibit only low magnetic properties. In the magnet alloy ribbon having an area ratio of less than 3%, the heat conductivity between the roll and the magneto alloy ribbon is excessively high, thereby causing a large difference between the cooling rate of the roll surface and the cooling rate of the opposite surface (referred to as "the free surface" in the present invention), which does not contact the roll. Therefore, variations in the crystal gain diameter in the roll surface and the free surface are increased, thereby deteriorating magnetic properties. Also, in the magnet alloy ribbon having an area ratio of less than 3%, the rapidly solidified ribbon tends to adhere to the roll because of the high adhesion between the roll and the ribbon, thereby deteriorating the yield of the magnet alloy ribbon. In some cases, the roll is rotated with the ribbon adhered thereto, and a new melt is jetted on the roll. In such a case, the cooling rate of a portion solidified by newly jetting on the ribbon, which adheres to the roll, is very low, and thus the crystal grains are coarsened, thereby deteriorating the magnetic properties of the alloy ribbon obtained.

Since the magnet alloy ribbon has the above-described characteristics, the magnetic properties of the alloy ribbon are reflected in production of the bonded magnet, and thus the alloy ribbon, in which the area ratio of the dimple-shaped recesses is 3 to 25%, is preferably used.

In consideration of the area of each of the dimples present in the roll surface, the total area ratio of the dimple-like recesses each having an area of over 2000 $\mu m^2$ is preferably lower than 5%. As a result of the same image analysis as described above, the presence of the dimple-like recesses each having an area of over 2000 $\mu m^2$ not only deteriorates the magnetic properties of the alloy ribbon itself, but also adversely affects the reliability of the resultant bonded magnet. Namely, the corrosion resistance of the bonded magnet deteriorates. This is possibly caused by the fact that the resin is localized in the dimple-like recesses having a large area in mixing the magnet powder and the resin, and uniform coating of magnetic powder is thus inhibited.

The depth of the dimple-like recesses also significantly affects the magnetic properties. For measurement of the depth, a laser displacement gage, a micrometer, a capacitance displacement gage, or the like may be used. In the examples of the present invention, which will be described below, for at least 20 individual dimple-like recesses of an alloy ribbon of one lot, the distance between the edge of each of dimples and the bottom thereof was measured as a depth, and the depths were averaged to obtain an average depth d. In order to calculate the average thickness of the alloy ribbon, the volume was calculated from the weight of the ribbon and the density measured by the Archimedes' method, and then divided by the width (the average of at least ten measurements obtained by using a microscope or the like) and the length of the ribbon.

When the d/t ratio is higher than 0.5, the magnetic properties of the alloy ribbon significantly deteriorate. In molding the bonded magnet, the porosity is hardly decreased, and the density is hardly increased, thereby deteriorating properties. In addition, the resin is insufficiently adhered to the dimple portions, thereby adversely affecting corrosion resistance. When the d/t ratio is less than 0.1, the adhesion between the alloy ribbon and the roll is increased, thereby undesirably causing the same problems as the case of a low area ratio (less than 3%).

Description will now be made of parameters in the production process for obtaining the magnet alloy ribbon having the above-described surface state. As described above, trapping of the inert gas is possibly mainly caused by the viscous gas flow generated near the roll with rotation of the roll. Therefore, it is preferable to take a measure for suppressing such a viscous flow. The inert gas atmospheric pressure in the chamber has the greatest effect. As the atmospheric pressure decreases, trapping of the gas decreases, and the area ratio of the dimple-like recesses also decreases. However, when the atmospheric pressure is excessively decreased, the area ratio becomes less than the range (3%) of the present invention, thereby deteriorating the magnetic properties, and causing variations in production of alloy ribbons. In addition, since an operation is carried out in a state close to a vacuum, various limitations occur in the apparatus used, thereby causing the problem of increasing the apparatus cost. Other parameters which influence include the area of the orifice, the melt temperature (viscosity), and the like.

The present invention will be described in further detail below with reference to examples.

EXAMPLE 1

Each of Nd, Fe and Co metals having a purity of 99.9% or more, and a Fe-B alloy (B 19 wt %) was weighed, and melted and cast in an Ar gas in a high-frequency induction melting furnace to obtain a round bar master alloy ingot having a diameter of 10 mm and the composition $Nd_{12}Fe_{bal.}Co_5B_{5.5}$.

About 15 g of sample per lot was cut out from the ingot, and an alloy ribbon was produced by such an apparatus as shown in FIG. 1. Each of the cut samples was placed in a quartz tube having a circular orifice of 0.6 mm Ø, and a current was passed through a heating coil to melt the sample in an Ar atmosphere. Then, the alloy melt was jetted on a copper roll rotated at 2000 rpm and having a diameter of 200 mm to obtain a magnet alloy ribbon. In producing the alloy ribbon, the Ar gas atmospheric pressure, and the Ar gas injection pressure were changed to obtain ribbons of a total of 8 lots.

For the thus-obtained alloy ribbons of 8 lots, the area ratio of the dimple-like recesses present in the roll surface was calculated by image analysis of SEM photographs according to the procedure described in the above embodiment. The magnetic properties of each of the alloy ribbons were measured by a vibrating sample magnetometer (VSM) with the maximum applied magnetic field of 1.44 MA/m in a state where the length direction of the ribbon was located in the direction of the applied magnetic field. Table 1 shows the results of measurement of the area ratio of the dimple-like recesses and magnetic properties of each of the lots.

TABLE 1

| Lot No. | Area ratio of dimple-like recess (%) | | iHc (MA/m) | $(BH)_{max}$ (kJ/m$^3$) |
|---|---|---|---|---|
| A1 | 2.3 | Comparative Example | 0.64 | 38.4 |
| A2 | 3.0 | This invention | 0.85 | 124.3 |
| A3 | 7.8 | This invention | 0.79 | 140.5 |
| A4 | 11.2 | This invention | 0.84 | 138.2 |
| A5 | 19.8 | This invention | 0.78 | 135.9 |
| A6 | 25.0 | This invention | 0.70 | 125.1 |
| A7 | 27.2 | Comparative Example | 0.35 | 81.1 |
| A8 | 35.1 | Comparative Example | 0.28 | 52.8 |

This table indicates that good magnetic properties are obtained in the range of area ratios of 3 to 25%, and magnetic properties deteriorate outside this range.

Several alloy ribbons were formed by the same method as described above using an ingot having each of the compositions shown in Table 2 at a roll rotational speed of 2000 rpm.

TABLE 2

| | |
|---|---|
| Composition A | $Nd_{12}Fe_{bal.}Co_5B_{5.5}$ |
| Composition B | $Nd_{4.5}Fe_{bal.}Co_5B_{5.5}$ |
| Composition C | $Nd_{8.5}Fe_{bal.}B_{5.5}$ |

Each of the alloy ribbons was ground by a kneader to form a powder, which was the mixed with 1.8 wt % of epoxy resin, and molded by a press under a pressure of 6 ton/cm$^2$ to produce a bonded magnet of 10 mm Ø×7 mm t. The magnetic properties of the thus-obtained bonded magnets were measured in a maximum applied magnetic field of 2 MA/m by a DC recording flux meter. Table 3 shows the area ratio of dimple-like recesses and magnetic properties of each of the alloy ribbons. This invention and comparative examples were discriminated according to the area ratio.

TABLE 3

| Composition | Lot No. | | Area ratio (%) | iHc (MA/m) | $(BH)_{max}$ (kJ/m$^3$) |
|---|---|---|---|---|---|
| Composition A | BM-Aa | This invention | 9.8 | 0.89 | 110.2 |
| | BM-Ab | This invention | 14.7 | 0.83 | 105.9 |
| | BM-Ac | Comparative Example | 32.4 | 0.38 | 43.5 |
| Composition B | BM-Ba | This invention | 4.8 | 0.39 | 78.3 |
| | BM-Bb | This invention | 20.4 | 0.35 | 72.6 |
| | BM-Bc | Comparative Example | 2.6 | 0.18 | 10.3 |
| | BM-Bd | Comparative Example | 26.7 | 0.09 | 20.4 |
| Composition C | BM-Ca | This invention | 8.2 | 0.61 | 122.1 |
| | BM-Cb | This invention | 24.3 | 0.64 | 128.2 |
| | BM-Cc | Comparative Example | 40.2 | 0.26 | 32.4 |

This table indicates that good magnetic properties can be achieved by the bonded magnet formed by using the alloy ribbon having dimple-like recesses at an area ratio in the range of the present invention.

EXAMPLE 2

A magnet alloy ribbon was produced by using a sample cut off from the ingot having the composition C shown in Table 2. The roll material, and the rotational speed were the same as Example 1, and the other conditions including the injection conditions, atmospheric conditions, etc. were changed to obtain magnetic alloy ribbons of a total of 6 lots. For each of the thus-obtained alloy ribbons, the area ratio of dimple-like recesses each having an area of 2000 $\mu m^2$ or more was measured by image analysis.

Then, each of the alloy ribbons was ground to form a magnet powder, which was then mixed with 1.8 wt % of epoxy resin and compression-molded under a pressure of 6 ton/cm$^2$ to obtain a bonded magnet of 10 mm×7 mm t. The magnetic properties of each of the thus-obtained bonded magnets were measured by a DC reading flux meter with a maximum applied magnetic field of 2 MA/m. Also corrosion resistance of each of the magnets was evaluated by a constant-temperature-constant-humidity test at 60° C. and 95% RH for 500 hours. The presence of rust on the surfaces was visually observed.

Table 4 shows the results of the area ratio of dimple-like recesses each having an area of 2000 m$^2$ or more, magnetic properties, and corrosion resistance of each of the alloy ribbons. In regard to evaluation of corrosion resistance, a magnet causing no rust is marked with ○, and a magnet causing rust is marked with x.

TABLE 4

| Lot No. | Area ratio (%) | iHc (MA/m) | $(BH)_{max}$ (kJ/m$^3$) | Corrosion resistance |
|---|---|---|---|---|
| BM-Ce | 0 | 0.59 | 121.9 | ○ |
| BM-Cf | 1.2 | 0.63 | 125.1 | ○ |
| BM-Cg | 2.8 | 0.65 | 119.2 | ○ |
| BM-Ch | 5.0 | 0.55 | 120.7 | ○ |
| BM-Ci | 6.3 | 0.48 | 85.4 | x |
| BM-Cj | 10.2 | 0.24 | 51.3 | x |

This table indicates that a bonded magnet having good corrosion resistance and magnetic properties can be obtained from an alloy ribbon having dimple-liked recesses each having an area of 2000 $\mu m^2$ or more at an area ratio of 0 to 5%.

EXAMPLE 3

A round bar-shaped master alloy ingot having the composition (Composition D) $Nd_{11}Fe_{bal.}Co_8B_{6.5}V_{1.5}$ and a diameter of 10 mm Ø was obtained by the same method as Example 1.

A sample of about 15 g per lot was obtained from this ingot, and then placed in a quartz tube having a circular hole orifice of 0.6 mm Ø provided at the bottom thereof. A current was passed through a heating coil to melt the sample in an Ar atmosphere, and the resultant melt was jetted on a copper roll having a diameter of 200 mm and rotating at 4000 rpm to obtain a magnet alloy ribbon. In producing an alloy ribbon, injection conditions and atmospheric conditions were changed to obtain alloy ribbons of a total of 8 lots. For each of the thus-obtained ribbons, the d/t ratio of the average depth to the average thickness was measured by the method described above in the embodiment.

As a result of X-ray diffraction of the alloy ribbons, all diffraction peaks were broad peaks. It was thus confirmed that the structure of each of the alloy ribbons is partially amorphous. After heat treatment in Ar at 650° C. for 10 minutes, the magnetic properties of these ribbons were measured by the same method as Example 1.

Table 5 shows the d/t value and magnetic properties of each of the alloy ribbons.

TABLE 5

| Lot No. | d/t | | iHc (MA/m) | $(BH)_{max}$ (kJ/m$^3$) |
|---|---|---|---|---|
| D1 | 0.05 | Comparative Example | 0.68 | 77.8 |
| D2 | 0.10 | This invention | 0.81 | 133.2 |
| D3 | 0.18 | This invention | 0.83 | 136.0 |
| D4 | 0.28 | This invention | 0.79 | 131.5 |
| D5 | 0.36 | This invention | 0.82 | 128.3 |
| D6 | 0.50 | This invention | 0.72 | 125.1 |
| D7 | 0.55 | Comparative Example | 0.35 | 85.4 |
| D8 | 0.64 | Comparative Example | 0.28 | 41.9 |

This table indicates that good magnetic properties can be obtained by an alloy ribbon having a d/t ratio of 0.1 to 0.5.

Several alloy ribbons were formed by using an ingot having each of the compositions shown in Table 6 at a roll rotational speed of 4000 rpm, with the injection conditions and atmospheric conditions changed. The d/t ratio of each of the ribbons was measured.

TABLE 6

| | |
|---|---|
| Composition E | $Nd_{13}Fe_{bal.}B_{5.5}Nb_{1.0}$ |
| Composition F | $Nd_{9.0}Fe_{bal.}B_{6.0}Co_{1.0}$ |

After heat treatment at a temperature higher than the crystallization temperature of each of the compositions for 10 minutes, each of the ribbons was ground by a kneader to form a powder which was then mixed with 1.8 wt % of epoxy resin, and compression-molded under a pressure of 6 ton/cm$^2$ to obtain a bonded magnet of 10 mm Ø×7 mm t. The magnetic properties of each of the bonded magnets were measured by a DC reading flux meter in a maximum applied magnetic field of 2 mA/m. Also corrosion resistance of each of the magnets was evaluated by a constant-temperature-constant-humidity test at 60° C. and 95% RH for 500 hours. The presence of rust on the surface was determined by visual observation.

Table 7 shows the results of measurement of the area ratio, magnetic properties, and corrosion resistance of each of the alloy ribbons. In the table, in evaluation of corrosion resistance, a magnet causing no rust is marked with ○, and a magnet causing rust is marked with x.

TABLE 7

| Composition | Lot No. | | area ratio (%) | $(BH)_{max}$ (kJ/m$^3$) | Corrosion resistance |
|---|---|---|---|---|---|
| Composition E | BM-Ea | This invention | 4.8 | 65.0 | ○ |
| | BM-Eb | This invention | 20.4 | 63.2 | ○ |
| | BM-Ec | Comparative Example | 2.6 | 39.8 | x |
| | BM-Ed | Comparative Example | 26.7 | 41.2 | x |
| Composition F | BM-Fa | This invention | 8.2 | 120.7 | ○ |
| | BM-Fb | This invention | 24.3 | 118.3 | ○ |

TABLE 7-continued

| Composition | Lot No. | | area ratio (%) | $(BH)_{max}$ (kJ/m$^3$) | Corrosion resistance |
|---|---|---|---|---|---|
| | BM-Fc | Comparative Example | 40.2 | 50.1 | x |

This table reveals that a bonded magnet having good corrosion resistance and magnetic properties can be obtained from an alloy ribbon having a an area ratio in the range of the present invention.

What is claimed is:

1. A magnet alloy ribbon obtained by jetting a rare earth element-transition metal-boron alloy melt on a rotating metallic roll to rapidly solidify the alloy melt, wherein a total area ratio of dimple recesses after solidification, which are present in a surface of the ribbon in contact with the roll during solidification, is 3 to 25%.

2. A magnet alloy ribbon obtained by jetting a rare earth element-transition metal-boron alloy melt on a rotating metallic roll to rapidly solidify the alloy melt, wherein a total area ratio of dimple recesses, which are present in a surface of the ribbon in contact with the roll during solidification and each of which has an area of 2000 $\mu m^2$ or more, is 0 to 5%.

3. A magnet alloy ribbon obtained by jetting a rare earth element-transition metal-boron alloy melt on a rotating metallic roll to rapidly solidify the alloy melt, wherein a d/t ratio of an average depth (d) of dimple recesses after solidification to an average thickness (t) of the alloy ribbon, which recesses are present in a surface of the ribbon in contact with the roll during solidification, is 0.1 to 0.5.

4. A resin bonded magnet obtained by grinding a magnet alloy ribbon before or after heat treatment, which is obtained by jetting a rare earth element-transition metal-boron alloy melt on a rotating metallic roll to rapidly solidify the alloy melt, to form a powder; mixing the powder and a resin into a mixture; and then molding the mixture; wherein a total area ratio of dimple recesses after solidification, which are present in a surface of the ribbon in contact with the roll during solidification, is 3 to 25%.

5. A resin bonded magnet obtained by grinding a magnet alloy ribbon before or after heat treatment, which is obtained by jetting a rare earth element-transition metal-boron alloy melt on a rotating metallic roll to rapidly solidify the alloy melt, to form a powder; mixing the powder and a resin into a mixture; and then molding the mixture; wherein a total area ratio of dimple recesses, which are present in a surface of the ribbon in contact with the roll during solidification and each of which has an area of 2000 $\mu m^2$ or more, is 0 to 5%.

6. A resin bonded magnet obtained by grinding a magnet alloy ribbon before or after heat treatment, which is obtained by jetting a rare earth element-transition metal-boron alloy melt on a rotating metallic roll to rapidly solidify the alloy melt, to form a powder; mixing the powder and a resin into a mixture; and then molding the mixture; wherein a d/t ratio of an the average depth (d) of dimple recesses after solidification to an average thickness (t) of the alloy ribbon, which recesses are present in a surface of the ribbon in contact with the roll during solidification, is 0.1 to 0.5.

* * * * *

UNITED STATES PATENT AND TRADEMARK OFFICE

CERTIFICATE OF CORRECTION

PATENT NO. : 6,187,217 B1
DATED : February 13, 2001
INVENTOR(S) : Akira Arai et al.

It is certified that error appears in the above-identified patent and that said Letters Patent is hereby corrected as shown below:

Column 2,
Line 16, delete "power" and insert -- powder -- therefor.
Lne 50, "therefor" should be -- other aspects --.

Column 3,
Line 19, after "extended" insert -- along a length 23 --.
Line 32, "ribbon) 24" should be -- ribbon 24) --.

Column 4,
Line 39, delete "therefore".
Line 42, after "surface" insert -- 21 --.

Column 5,
Line 18, delete "gain" and insert -- grain -- therefor.
Line 57, after "of" insert -- the --.

Column 7,
Line 30, "the" should be -- then --

Column 8,
Line 18, "2000 $m^2$" should be -- 2000 $\mu m^2$ --.
Line 37, delete "dimple-liked" and insert -- dimple-like -- therefor.

Column 10,
Line 57, delete "the".

Signed and Sealed this

Sixteenth Day of October, 2001

*Attest:*

Nicholas P. Godici

*Attesting Officer*

NICHOLAS P. GODICI
*Acting Director of the United States Patent and Trademark Office*